United States Patent [19]

Chapman

[11] Patent Number: 4,922,797

[45] Date of Patent: May 8, 1990

[54] LAYERED VOICE MUSICAL SELF-ACCOMPANIMENT SYSTEM

[76] Inventor: Emmett H. Chapman, 6011 Woodlake Ave., Woodland Hills, Calif. 1367-3238

[21] Appl. No.: 283,543

[22] Filed: Dec. 12, 1988

[51] Int. Cl.[5] ..... G10H 1/057; G10H 1/36

[52] U.S. Cl. ..... 84/650; 84/663; 84/DIG. 26

[58] Field of Search ..... 84/1.01, 1.03–1.16, 84/1.24–1.27, DIG. 4, DIG. 26, 650–652, 662, 663, 666–669, 701, 702, 707, 712–717, 721, 737, 738, 746, 626, 629, 634–638, 647; 381/51, 63

[56] References Cited

U.S. PATENT DOCUMENTS 4,194,426 3/1980 Deutsch et al. ..... 84/1.24

4,658,690 4/1987 Aitken et al. ..... 84/1.16 X

*Primary Examiner*—Stanley J. Witkowski

*Attorney, Agent, or Firm*—J. E. McTaggart

[57] ABSTRACT

The practice of this invention enables a musician to augment a main "lead voice" performance by extemporaneously deriving from particularly selected notes of the main performance a separate synthesized accompaniment in which particularly selected notes may be controllably time-extended (e.g. sustained) singly or in a group, in effect "detached" from the lead voice. The first of a pair of low profile footswitches enables/cancels accompaniment triggering; the second enables/cancels accompaniment time-extension. Switch logic is implemented such that the first switch can never override the second switch to cancel time-extension; thus a musician operating the switches interactively, typically one with each foot, is enabled, through strategic timing relative to the lead notes, to trigger accompaniment notes from particularly selected lead notes, to controllably time-extend particularly selected accompaniment notes, and to accumulate groups of such time-extended accompaniment notes. The invention is applicable to a wide range of lead voice sources including the guitar, The Chapman Stick® fingerboard instrument and its synthesizer controller version. The Grid®, guitar synthesizers, keyboard synthesizers, as well as acoustic, electrical and synthesized musical instruments of various types and even the human voice. The invention may be implemented using available MIDI-based equipment, specially configured. The practices are applicable to sustain, delay and echo effects. As a refinement, pitch bending in the accompaniment may be separately disabled, thus emphasizing pitch bending performed in the lead voice.

9 Claims, 2 Drawing Sheets

LAYERED VOICE MUSICAL SELF-ACCOMPANIMENT SYSTEM

FIELD OF THE INVENTION

This invention relates generally to the field of musical instruments, and more particularly to electronic equipment systems for synthesized self-accompaniment and related control processes enabling a musician, while playing a lead voice performance, to extemporaneously create an orchestral-like accompaniment by time-extending and accumulating selected accompaniment notes derived from notes of the lead voice, as sustained or repeatedly echoed notes, groupings of notes and chords.

BACKGROUND OF THE INVENTION

Resources for augmenting the performance of an individual musician through extemporaneous self-accompaniment have seen continuous development as new technology has become available and economical. As examples, the mechanical accordian, with bass and chord buttons, evolved to the electronic chord organ. In an example of such note-group pattern-generating devices, U.S. Pat. No. 4,366,739 to DeLong et al. discloses a system for playing chords from the pedalboard of an electronic organ. Automated chord formation of this type generally fails to satisfy the artistic needs of advanced musicians who prefer the freedom to express individual styling by structuring chords and note clusters in varied and unusual inversions and voicings.

Electronic organ and music synthesizer development has led to the current availability of functional electronic modules which may be combined as building blocks in musical instrument architecture. The widespread acceptance of MIDI (Musical Instrument Digital Interface) standards has greatly enhanced the interchangeability of such modules and facilitated their integration in interconnected combinations. The evolution of MIDI-based technology has provided unprecedented potential for creating novel synthesized self-accompaniment derived from a lead voice performance: the lead voice notes are encoded in MIDI format to provide Channel Voice messages comprising Note On event messages and Note Off event messages which include channel addressing, pitch (key #) and velocity (attack and release) data. Such messages along with system command messages are transmitted via standardized MIDI cables typically through one or more MIDI processing modules to a sound-generating device comprising a polyphonic tone generator module containing a bank of independent tone generator units addressed and command in real time by MIDI Voice Channel messages as described above.

Synthesizers have been adapted to enable an electric guitar to produce a synthesized sound much different from its natural sound by adapting the guitar to become a controller for a polyphonic tone generator in the synthesizer. On a typical six string guitar, each string is sensed with an individual magnetic pickup, providing six analog outputs, one from each string, which are encoded into MIDI formatted serial note data messages. These are processed and addressed to the tone generator which is programmed to automatically generate tones related in some predetermined manner to the notes played on the guitar. An example of prioritizing a polyphonic tone generator to maximize the utility of a limited number of channels is found in U.S. Pat. No. 4,706,538 to Yoshida.

In a basic mode, the tone generators are made to "pitch-track" the guitar performance: that is to play, for each guitar note played, a synthesized tone having the same pitch, Note On event timing and Note Off event timing as the guitar note but in a much different tonal color or timbre. For further variety, the processing may be programmed to offset the pitch up or down by a designated interval (such as a third, fifth of a chromatic or modal scale, or an octave). A switch usually is provided to enable the musician to bypass the synthesizer and play only amplified natural guitar sound. A more elaborate setup may provide performance of both the natural sound and the synthesized sound simultaneously.

The ability to sustain (and subsequently release) notes has long been recognized as an important resource in playing music. This ability is of particular importance in such instruments as acoustic guitars, where limited sustain effects are available through appropriate interaction of the strings, frets and fingers, and the piano, where the sustain pedal enables foot control to take over some of the sustaining tasks from the fingers. The problem limiting the musical potential of such sustaining capability is well-known: each note present or played with sustain enabled (sustain pedal down) becomes sustained, therefore playing a sequence of notes easily builds up a dissonant group of sustained notes. This problem is less severe if the sustained notes decay rapidly, as with the higher notes of the piano, but becomes more severe with the longer sustain of the acoustic guitar, and becomes especially severe with non-decaying sustained notes of electronic tone generators.

In synthesizers such as the guitar synthesizer described above, it is known to provide the player with capability of sustaining notes by temporarily suspending the normal immediate transmission of Note Off event messages and then sending them at a later time, typically under control of a foot switch, which thus acts in the manner of a piano sustaining pedal. As with the piano, there is no way for the player to sustain only particular non-sequential notes out of a played sequence, or to add new selected notes to a sustained group so as to accumulate a musically desired larger sustained group; therefore in known art the practice of pedal-sustaining is limited to a brief fill-in role since sustained groups must be promptly terminated by releasing the sustain pedal before playing any further passages containing notes not wanted in the sustained group. If the musician wishes to hold a sustained group as background accompaniment while proceeding independently with new lead passages, he must dedicate some of his fingers to the task of holding the sustained group since normal pedal-sustain fails to provide such facility.

It has been discovered in the conception of this invention that the limitations cited above may be overcome by a particular configuration of controlling equipment and manner of practice by a musician, enabling the selection of particular notes of a lead voice sequence for initiating corresponding sustained accompaniment notes, while inhibiting other notes of the lead voice sequence from initiating sustained accompaniment notes, and thus enabling the accumulation of a musically desired stack or voicing of sustained notes, over which the lead voice may be played independently, thus providing the musician with enhanced orchestral-like self-accompaniment capabilities significantly beyond those available in known art. Furthermore it has been found that the practice of the invention is beneficially applicable to other forms of time-extension of accompaniment notes, such as echo and reverberation, as well as sustain.

SUMMARY OF THE INVENTION

It is a primary object of the present invention to teach improvements in creating and controlling a synthesized musical accompaniment, derived from the notes played in a lead voice, by providing a musician with control means adapted to enable the musician to initiate (and terminate) the "pitch-tracking" accompaniment, to sustain or otherwise time-extend one or more accompaniment notes, to play further lead voice notes independently over the sustained accompaniment, to augment the sustained group repeatedly and whenever desired, by adding one or more new notes corresponding to particular lead voice notes after which further lead voice notes may be played independently, and finally to cancel accompaniment and/or sustain whenever desired, and to repeat the above sequence or variations thereof at will.

It is a further object of this invention to provide a pair of low profile foot-switches: an "accompaniment" switch adapted to provide on/off control of transmission of "note on" event messages, encoded from note parameters of a lead voice source, to a polyphonic tone generator module of an accompaniment synthesizer; and a "sustain" switch adapted to provide on/off control over sustaining of notes present in the tone generator module by delaying "note off" event messages for as long the "sustain" switch is held "on": whereby, after accumulation of one or more sustained accompaniment notes with both footswitches on, releasing the "accompaniment" footswitch to its "off" state will allow the previously accumulated sustain group to continue to sound but will inhibit generation of any new accompaniment notes, allowing new lead voice passages to be played independently over the previously established sustained accompaniment.

It is still a further object, in combination with the objects stated above, to utilize the special sustaining practices of the invention to similarly time-extend accompaniment notes using such effects as finitely and infinitely repeated echo, which, as an option, may be synchronized to a rythmic pulse, and reverberation.

The basic principles of the invention will be best understood from study of the following drawings and description.

DETAILED DESCRIPTION

Figure 1:
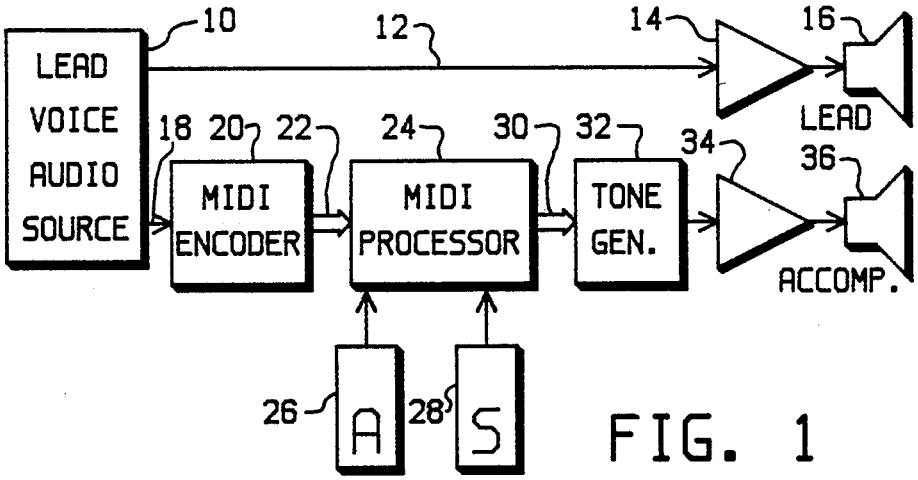
FIG. 1 is a functional block diagram showing the essential elements of a lead voice and accompaniment system configured in accordance with the present invention.

FIG. 1 is a conceptual block diagram of the basic functional elements of a lead voice and accompaniment system configured in accordance with present invention. Lead voice 10 represents an analog audio signal source within a musical instrument upon which a musician is playing a musical performance.

Lead voice 10 could include any of a wide variety of acoustic, electric or synthesized musical instruments, or even the human voice. In special circumstances the lead voice may be sounded in a purely acoustic manner, however, most probably sound reinforcement will be applied in the normal manner as shown in FIG. 1 where an electrical audio signal, originating in a musical instrument pickup or microphone as part of lead voice 10, is delivered through signal line 12 to an audio amplifier 14 and loudspeaker system 16 of known art.

A second audio signal representing the lead voice performance, from which accompaniment is to be derived, is supplied to cable 18. If the lead voice 10 is monophonic, then the same monophonic signal could be supplied to both line 12 and cable 18; more typically lead voice 10 is polyphonic, supplying a single combined audio signal to line 12 and a group of parallel audio signals to cable 18, one for each polyphonic element. Cable 18 delivers the audio signals as input to a MIDI encoder 20, which encodes the significant attributes of lead voice notes into MIDI-formatted serial data, including Note On event messages and Note Off event messages, delivered by a MIDI interface cable 22 to a MIDI processor 24 which is controlled by two user-operated switches 26 and 28, typically thin profile footswitches of the momentary contact type which are normally "off" unless held "on" by foot pressure: switch 26, designated "A" for "accompaniment", and switch 28, designated S for "sustain"; these will be referred to henceforth as switch A and switch S respectively. MIDI messages from Processor 24 are transmitted via MIDI cable 30 to polyphonic tone generator 32, which contains a group of individual tone generators whose combined output is applied as an audio signal to the accompaniment audio system: conventional amplifier 34 and speaker system 36, which may be similar to, identical with, and/or integrated with the lead voice amplifier 14 and speaker system 16.

Processor 24, which typically comprises a microprocessor-controlled UART (Universal Asynchronous Receiver/Transmitter) having a standard MIDI opto-isolated input buffer and output driver, is programmed such that switch A provides on/off control over the transmission of Note On event messages, denoting the start of lead voice notes, to tone generator 32 for initiating corresponding accompaniment notes, and switch S provides on/off control over sustaining of accompaniment notes. In the "off" state of switch S, Note Off event messages are each transmitted to tone generator 32 immediately as generated from the lead voice such that each Note On event message becomes cancelled by a subsequent Note Off event message immediately when the lead voice note ends, so that the accompaniment notes start and stop with the same timing as the lead notes, i.e. there is no sustaining. In the "on" state of switch S, the transmission of Note Off event messages is suspended for as long as switch S is held "on", thus sustaining notes present in the tone generator 32; and then, upon release of switch S to the "off" state, a set of Note Off event messages addressed to the specific channels being sustained (or a system Note Off event message addressed to all channels) is transmitted to tone generator 32 to end all active notes thusly addressed.

These two switches A and S provide four distinct operating modes, depending on the off/on state of each switch, as follows:

mode "as" (accompaniment off—neither switch pressed): no accompaniment is derived from the lead voice performance since no new Note On event messages reach tone generator module 32. Invoking this mode at any time during a performance immediately terminates all accompaniment notes including any sustained notes;

mode "As" (accompaniment only—only A pressed): this is the standard "pitch-tracking" mode; each lead note played initiates a corresponding pitch-related accompaniment note. Both Note On event messages and Note Off event messages received from encoder 20 are transmitted immediately to the tone generator module 32 so that accompaniment notes start and end at the same instant as corresponding lead voice notes, so there is no sustaining, i.e. no accompaniment note is heard beyond the ending of the corresponding lead note;

mode "AS" (accompaniment sustain—both A and S pressed): when this mode is initiated, transmission of Note Off event messages becomes suspended, thus any accompaniment notes(s) present in tone generators of module 32 at that time plus any new accompaniment notes initated by playing more lead notes will be sustained as long as S is held "on";

mode "aS" (sustain—only S pressed): any accompaniment notes present in the tone generators of module 32 at the moment of entering this mode will be sustained by inhibiting transmission of Note Off event messages as long as S is held "on", but new lead voice notes will not initiate any further accompaniment notes, therefore a lead voice passage may be played independently over a background of sustained notes already present, which will continue to sound as a sustained group as long as S remains pressed and thus held "on";

It should now be apparent that the musician, simply operating two switches, one with each foot, can shift strategically among these four modes in time relationship to the lead voice so as to create orchestral-like sustained accompaniment voicings interwoven with the lead voice. There are twelve possible transition paths between these four modes: as->As, As->AS, AS->aS, aS->as, as->AS, As->aS plus the reverse direction of each of these six. One of these, as->aS is ineffective, and is disregarded in practice since in the off mode "as" there can be no notes present for sustaining so the accompaniment would remain silent upon transitioning to mode "aS". However each of the eleven other transitions provide a valid mode change, offering the musician a wide range of sequential options in extemporaneously formulating the accompaniment in interaction with the lead voice passage.

The practice of "layered voice" accompaniment in accordance with this invention is illustrated by the following basic sequence:

A musician begins playing in mode "as" (neither switch pressed): only the lead voice will be heard since switch A inhibits flow of note data. Pressing A to invoke mode "As" provides "pitch-tracking" accompaniment with no sustain. If a chord or a note is then played and held, the corresponding accompaniment chord or note may be sustained by pressing and holding S (while continuing to press A) to invoke mode "AS", whereupon the chord or note will be sustained as long as switch S remains pressed, and now each new lead note played will produce a corresponding accompaniment note and will sustain it as an addition to the sustained group.

At this point, A may be released (while holding S pressed) to invoke mode "aS" whereupon any number of new lead notes may be played over the sustained accompaniment group without adding any new notes to the sustained accompaniment.

Whenever the musician, in mode "aS", decides to add a particular note to the sustained accompaniment he simply presses A (while continuing to hold S pressed) to invoke mode "AS" while the desired note is sounding in the lead voice: this initiates a corresponding sustained accompaniment note and adds it to the sustained group, then A may be released to recall mode "aS", whereupon the now-augmented sustained accompaniment group continues to sound as background for new independent lead voice passages. This same technique can be used to "capture" several notes played together on different strings as chords or played sequentially as a melody line.

At any time the musician may immediately discontinue further accompaniment, including any sustained notes, by releasing both A and S.

Figure 2:
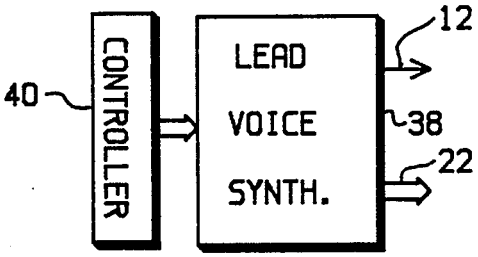
FIG. 2 is a block diagram showing a music synthesizer serving as a MIDI-encoded lead voice source as an alternative to the analog source and MIDI encoder of FIG. 1.

The block diagram of FIG. 2 shows the utilization of a music synthesizer 38 to provide the functions provided in FIG. 1 by the combination of the lead voice source 10, signal cable 18 and MIDI encoder 20. Synthesizer 38, and its associated controller 40 which may be a piano-type keyboard or specially adapted musical instrument, provides an analog audio output port suitable for feeding the lead voice audio system through line 12 as well as a MIDI output port providing note data through cable 22 to the accompaniment system. Since this note data is already in MIDI format the separate MIDI encoder 20 of FIG. 1 would not be required. The balance of the accompaniment system would be configured as shown in FIG. 1 to the right of cable 22, and operated as described above in connection with FIG. 1.

Figure 3:
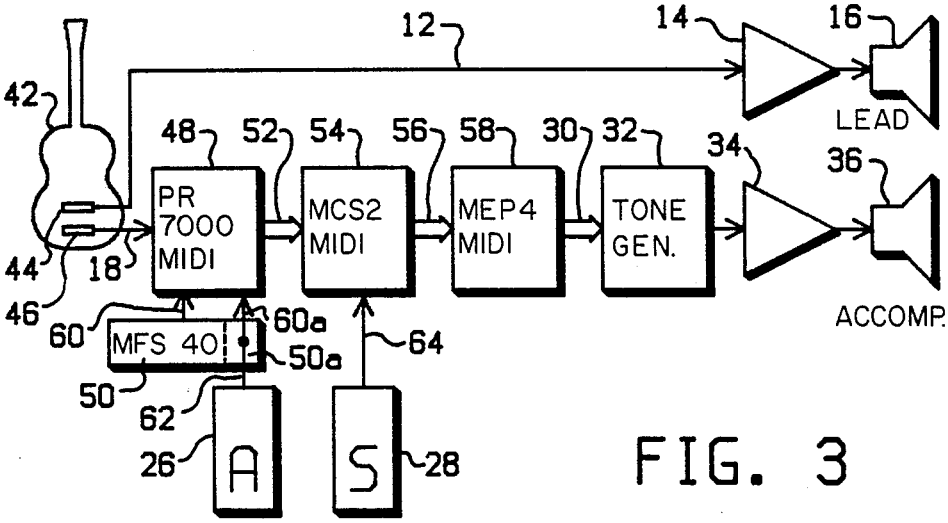
FIG. 3 is a block diagram of an illustrative embodiment of the present invention utilizing commercially available electronic musical instrument modules interconnected in a manner to enable practice of this invention.

The block diagram of FIG. 3 shows an illustrative embodiment of this invention in a setup of commercially-available musical equipment modules interconnected to provide an accompaniment system with which a musician may practice the procedures and capabilities of the invention as described above in connection with FIG. 1.

The lead voice is performed on a conventional six-string guitar 42, amplified in the well-known usual manner wherein the signal from a standard magnetic type guitar pickup 44 is transmitted via line 12 to the amplifier 14 and speaker system 16 providing the lead voice sound. Guitar 42 is additionally fitted with a polyphonic pickup device 46 which provides six analog outputs, one for each string, transmitted via multiple shielded cable 18 to module 48 which is a PITCHRIDER Model 7000 interface unit, manufactured by IVL Technologies Ltd., which provides the MIDI encoding function (module 20 in FIG. 1) as well as the Note On event message controlling function (part of module 24 in FIG. 1) commanded by switch A. The polyphonic pickup device 46 for installation on guitar 42, and a multi-function footswitch controller 50, MODEL MFS-40, are available as accessories to the PITCHRIDER Model 7000, module 48.

In module 48, the six analog input signals are converted to a MIDI-formatted polyphonic note data stream which is interruptable in response to actuation of a "bypass" switch 50*a*, part of the MFS-40 footswitch controller 50. Cable 60 which connects controller 50 to module 48 includes wiring 60*a* connected to bypass switch 50*a*.

As originally supplied, the PITCHRIDER Model 7000, module 48, is programmed such that the "bypass" switch 50*a* operates as a sequential (push on-push off) type. For the practice of this invention, a modification available from IVL Technologies permits the "bypass" switch 50*a* to operate as a momentary type, as a selectable option. The physical arrangement of the "bypass" footswitch 50*a*, although suitable for playing from a seated position, is not ideal from a standing position, therefore the "bypass" switch 50*a* itself is not utilized: instead its wiring 60*a* is extended by wiring 62 to a separate thin profile instantaneous type footswitch 26 to act as switch A in the practice of this invention.

The PITCHRIDER Model 7000, module 48, provides the additional capabilities of disabling pitch bend and of offsetting pitch to transpose the accompaniment; these capabilities, when utilized separately or together in conjunction with layered voice sustain as taught by this invention, provide important enhancements.

Pitch bend disabling capability is particularly beneficial when accompaniment notes are sustained in accordance with this invention. Pitch-bending performed in the lead voice would ordinarily be carried over automatically into a pitch-tracked accompaniment; however this tends to compete with and detract from the expressive impact of pitch-bending in the lead voice, and also may leave an unwanted pitch offset on sustained notes, therefore it is desirable to have the option of disabling pitch-bending in the accompaniment so that each note sounds at normal pitch.

The sustaining capability of module 24 in FIG. 1 is provided by a Yamaha model MCS2 (MIDI Control Station) serving as module 54 in FIG. 3, which, under control of footswitch 28 as switch S, provides the function of sustaining accompaniment notes by delaying Note Off event message transmission for as long as switch S is held "on". Footswitch 28, which is similar to footswitch 26, is connected by cable 64 to a receptacle designated "FS1" on the MCS2, module 54.

For providing further special effects particularly well-suited for use in combination with the sustained accompaniment of this invention, an event processor module 58 such as Yamaha Model MEP4 (MIDI Event Processor) may be connected between sustain module 54 and tone generator module 32 by MIDI cables 56 and 30 as shown.

Model MEP4 as module 58 is capable of providing echo effects, which are particularly effective when utilized in accordance with the accompaniment practices of this invention. A single echo, which is implemented as a designated time delay applied to Note On event messages and Note Off event messages" data, may be considered a "delay" effect. Echo effect, processed for a finite number of repeats or for infinite repeat, at predetermined intervals, may be made the predominant time-extended feature in the practice of this invention instead of a sustained note. Echo may be placed under control of either switch S or a separate footswitch; in either case the footswitch would be operated in cooperation with switch A to control echo in the same manner as sustain, as described above in connection with FIG. 1 and FIG. 3, and as follows in connection with FIG. 4.

In a further refinement, a single or recurrent echo may be synchronized to a rythmic pulse by controlling the echo recurrence from a MIDI-based clock of the type provided in sequencers and drum machines. Such synchronized recurrent echo auto-corrects the time interval between the lead notes and corresponding accompaniment notes, thus imposing a strict rythm upon self-accompaniment practiced in accordance with this invention.

Similarly, the invention may be practiced utilizing reverberation as an alternative to sustaining.

The function of tone generator module 32 may be provided by a YAMAHA Model TX802 tone generator containing eight individual tone generator units. The number of accessable tone generator units may be designated in a setup program to be less than the total provided in order to create a desired note density or "texture" in the accompaniment. Module 32 is normally programmed to address each note received in the MIDI signal to an inactive tone generator unit; if all accessable tone generator units are active then the "oldest" active note is dismissed and replaced by the new one, in "first in - first out" priority.

With the availability of numerous MIDI processing devices, there are alternative equipment setups with which the present invention could be practiced, provided the processing system satisfies the essential requirements stated for module 24 in FIG. 1, especially with regard to the particular control logic requirement that operation of switch A to its "off" state must not be allowed to terminate notes being sustained by holding switch S "on".

Single processor modules known in present art fail to satisfy the above stated logic requirement. For example, the PITCHRIDER system comprising Model 7000 with its MFS-40 foot control unit provides normal sustaining capability, however the PITCHRIDER system alone fails to satisfy the above stated logic requirement: in attempting to practice the present invention by using the MFS-40 "bypass" footpad for the A function and the MFS-40 "sustain" footpad for the S function, it will be found that switching to the "off" state of the "bypass" switch immediately cancels all accompaniment including sustained notes, with the result that only two active modes are available: mode "As" and mode "AS", since mode "aS" simply becomes another inactive "off" mode like mode "as". It is for this reason that the practical setup of FIG. 3, while implementing the switch A function in module 48, utilizes a separate module 54 for its independent sustaining capability under control of switch S so that accompaniment notes continue to sustain as long as switch S is held on, even if switch A is released to its "off" state while notes are being sustained.

In the alternative setup shown in FIG. 1, although MIDI processors having the capabilities required in module 24 as stated above are not known to be commercially available in present art, it is within the competence of designers of MIDI-based electronic circuitry to implement the necessary control logic in a single processor module 24.

Figure 4:
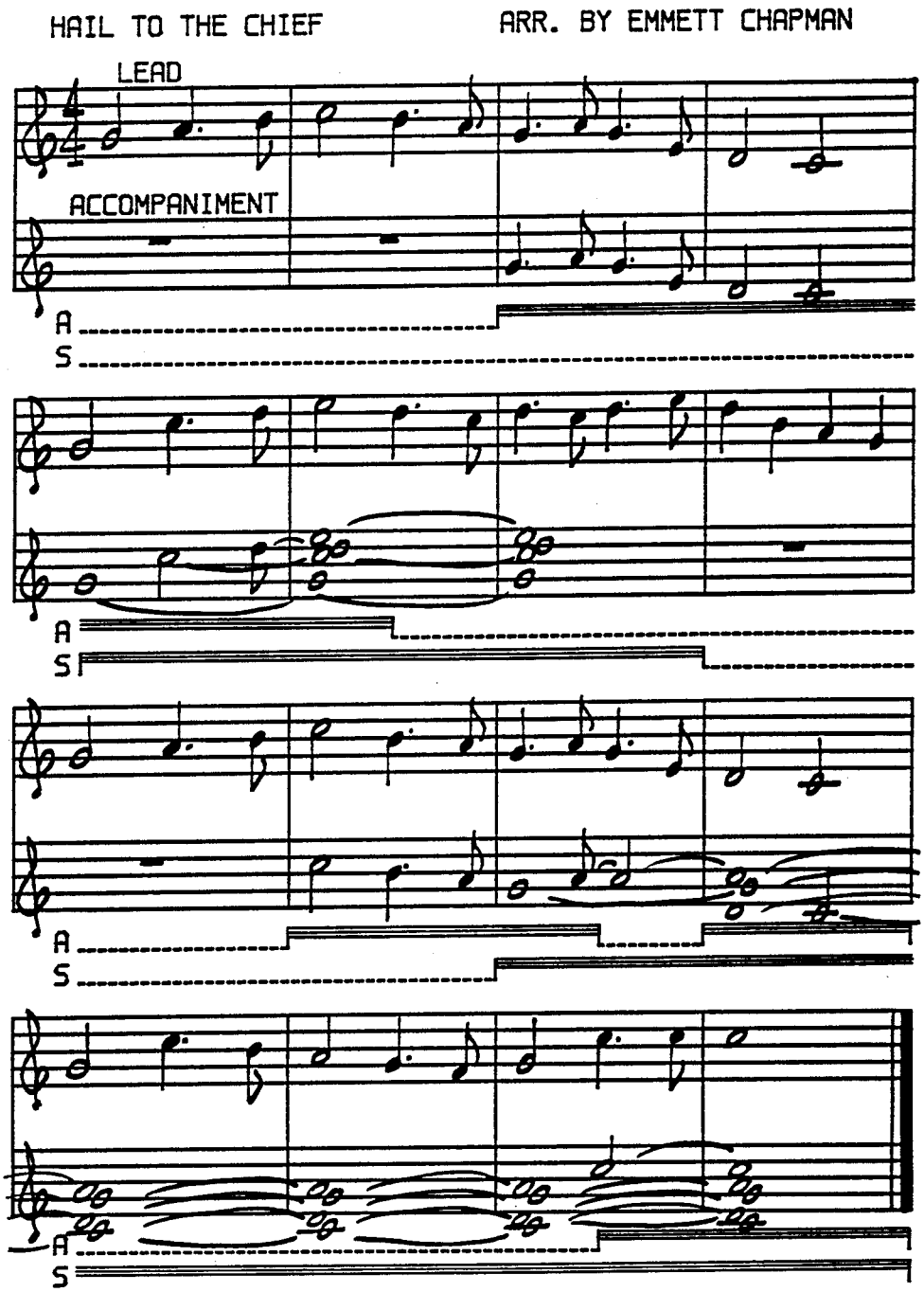
FIG. 4 is a musical score denoting a particular known piece of music performed in a lead voice and a specific example of a corresponding sustained group accompaniment, illustrating in detail the manner of operating two footswitches to derive the accompaniment from the lead voice in accordance with practices of this invention.

Turning now to FIG. 4, as a further aid in understanding the manner of using this invention, an example is presented in the form of a musical score which demonstrates how this invention enables the creation of a typical accompaniment as derived from a particular lead voice performance, with reference to the operation of footswitches A and S in FIG. 1 and FIG. 3.

In the double staff lines of musical notation, the upper staff represents the lead voice performing the traditional musical selection, "Hail to the Chief", as performed on the guitar and sounded from the lead voice speaker system 16, and the lower staff represents the accompaniment sounded from the accompaniment speaker system 36. The horizontal lines below the lower staff indicate the states of switches A and S in time correspondence with the musical notes above; the thick dark line indicating an "on" (pressed) state and the lighter dashed line indicating an "off" (released) state.

During the first two measures, in mode "as" (neither switch pressed), only the normal guitar sound of lead voice is heard.

At bar 3, pressing A invokes mode "As", whereupon accompaniment is heard, "pitch-tracking" along with the lead passage. In the musical notation, the synthesized accompaniment part appears to duplicate the lead, each corresponding note being equal in pitch and in duration; however the synthesized accompaniment will sound very different from the guitar lead voice due to differences in timbre or voice coloring. The accompaniment is assumed to be set up for a unison "pitch-tracking" condition for clarity and ease of understanding in this example; however as an option, an offset-pitch-interval condition would produce two-part parallel harmony between the lead and the accompaniment.

At bar 5, S is pressed (while A remains pressed) to invoke mode "AS": whereupon each accompaniment note becomes sustained beyond the duration of the corresponding lead note, and new sustained notes, initiated by new lead notes as played, are accumulated in the accompaniment during the following 1½ measures, building up to a sustained accompaniment group of four notes.

At the middle of measure 7, A is released (while S remains pressed) invoking mode "aS", whereupon it is seen that the four sustained notes continue to sustain, but no new notes are added to the sustained accompaniment group.

At bar 8, S is released to revert to mode "as": now in its "off" mode, the accompaniment is silent, and the lead voice sounds alone for two measures.

At bar 10, A is pressed and held while three notes played produce accompaniment in mode "As"; then at bar 11, S is also pressed, causing the first two notes of the measure to become sustained in the accompaniment; however the A switch is released while S is held during the following two notes, so that these two notes sound in the lead voice only, over the two sustained notes.

Then A is held "on" for the duration of measure 12, to add two more notes to the sustained group. Releasing A at bar 13 allows seven notes of lead passage to be played over the constant four note sustained accompaniment for 2½ measures in mode "aS".

Then A is pressed at the middle of measure 15 to add one more note to the accompaniment, which sounds a five note group to the end of measure 16. Over the duration of the last three lead notes which are of the same pitch, the corresponding accompaniment note is held continuously as an addition to the four other notes of the sustained accompaniment group due to sustaining action enabled by switch S in mode "AS".

Finally, at the end of measure 16, releasing both switches causes a transition from mode "AS" to mode "as", ending the sustained accompaniment concurrent with the end of the lead voice passage.

There are a number of alternative embodiments in which the invention may be practiced. As an example, assuming many musicians may already have all of the elements shown in FIG. 1 with the exception of the control processor 24 and footswitches A and S, such musicians would already have the capability of deriving a pitch-tracking accompaniment using a setup as shown except that, in the absence of module 24, encoder module 20 would be connected directly to the tone generator module 32 through cable 22. It is contemplated to provide module 24 with MIDI input and output ports, an extra MIDI cable 30 and the two footswitches as a dedicated accessory product which could be readily integrated into the musician's existing system to enable practice of this invention. Optionally the processor 24 in the accessory product could be made to include additional capabilities, preferably those such as transposing, pitch disable and repeated echo as described above in connection with modules 48 and 58 of FIG. 3.

There are possible alternatives to the "sustain capture" protocol in mode "AS" as described above in reference to FIG. 1: it could be predetermined that (a) only those notes played after pressing S would produce sustained accompaniment notes, or (b) only those notes present at the moment of pressing S would produce sustained accompaniment notes. The choice between such options is subjective, (a) being considered a close second choice to the preferred protocol described above for mode "AS" in connection with FIG. 1, and (b) being considered third choice. Options (a) or (b) could be implemented in module 24 by special logic circuitry to enable switch S to delay Note Off event messages to only selected ones instead of all of the active tone generators. A desired protocol may be permanently implemented, or else a setup switch or "patch" option may be provided to allow user selection between several "sustain capture" protocols, such alternative design approaches being within the competence of MIDI circuit designers.

Footswitches A and S could be made to operate in a latching (push-on, push-off) mode instead of the momentary mode described above; or they may be programmed to provide an "intelligent" time-dependent combination of both modes, for example operating in latching mode if "kicked" on for less than one second, but automatically changing to momentary mode if held down for more than one second.

The Chapman Stick, a ten-stringed instrument, related to the guitar family but played by tapping rather than plucking the strings (U.S. Pat. Nos. 3,833,751, 3,868,880 and 4,633,754), is particularly well-suited to serve as lead voice source 10 of this invention. The standard version of The Stick is adapted to this invention in the same manner as described above for the illustrative embodiment of FIG. 3 except that the regular pickup 44 is a dual type having a first section for a 5 string melody group and a second section for a 5 string bass group, the signal from the two sections being combined to provide a natural string signal on line 12 for the lead voice, and the accompaniment pickup 46 is a special five string polyphonic pickup added to The Stick, providing five analog accompaniment signals on cable 18, one for each string of the melody group.

A special version of The Stick, known as "The Grid" and equipped with a ten string polyphonic pickup may be utilized in conjunction with a MIDI encoder (module 20 in FIG. 1) to function as controller 40 in FIG. 2. The synthesizer's audio output signal representing the lead voice is supplied to signal line 12. A corresponding ten string polyphonic MIDI signal is supplied as input to the accompaniment system through cable 22 for deriving "layered voice" sustained accompaniment in accordance with this invention.

The nature of the invention provides opportunities for numerous other variations, alternatives, and refinements that may become apparent to those of skill in the musical instrument field. The invention may be embodied in various other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. A musical accompaniment control system for providing selective sustain in a musical self-accompaniment synthesizer of the type wherein significant parameters of notes being played by a musician in a lead voice performance are encoded in a real-time note data signal including "note on" event messages and "note off" event messages transmitted to a polyphonic tone generator cooperating with an audio sound system so as to produce a musical accompaniment having notes related in pitch and timing to corresponding notes played in the lead voice source, said control system comprising, in combination:

an electronic signal processor adapted to controllably transmit said "note on" messages and said "note off" messages to said tone generator;

an "accompaniment" switch adapted to control said processor in a manner enabling the musician to repeatedly choose between an "off" state in which transmission of said "note on" event messages to said tone generator is inhibited, and an "on" state in which said "note on" event messages are transmitted to said tone generator; and a "sustain" switch adapted to control said processor in a manner enabling the musician to repeatedly choose between an "off" state wherein said "note off" event messages are transmitted immediately to said tone generator and an "on" state wherein transmission of said "note off" event messages is delayed for as long as said "sustain" switch remains in said "on" state, whereby the musician is enabled, through interactive operation of said "accompaniment" switch and said "sustain" switch in strategic time relationship with notes of said lead voice performance, to selectively sustain particular notes of said accompaniment and to build up a group of thusly sustained notes which can continue to sustain as background accompaniment over which new lead voice notes may be played independently.

2. The musical accompaniment control system as defined in claim 1 wherein said "accompaniment" switch and said "sustain" switch each comprise a low-profile footswitch of the momentary type which provides an "on" state while pressed downward and an "off" state while not pressed, said footswitches being disposed so as to facilitate operation by the musician from a standing position with one foot at each footswitch.

3. The musical accompaniment control system as defined in claim 1 further comprising, in combination therewith, accompaniment pitch-bend disabling means adapted to enable the musician, while applying pitch-bending to notes of said lead voice performance, to disable pitch-bending in said accompaniment notes.

4. A musical accompaniment system, for providing an electronically synthesized self-accompaniment including selective sustaining of accompaniment notes derived from notes played by a musician in a lead voice performance, said accompaniment system comprising, in combination:

a polyphonic lead voice source adapted to provide a plurality of audio signals representing the notes played in the lead voice performance;

an encoding module adapted to encode said audio signals into a MIDI-formatted note data signal comprising "note on" event messages and "note off" event messages;

a sustaining processor module, receiving as input said note data signal from said analog-to-MIDI encoding module, adapted to controllably sustain said accompaniment notes by delaying transmission of said "note off" event messages;

an electronic polyphonic tone generator module receiving as input said "note on" event messages and said "note off" event messages, adapted to produce therefrom an audio accompaniment signal in accordance with said note data as received from said processor module;

an "accompaniment" switch adapted to enable the musician to exercise on/off control over transmission of said "note on" event messages from said encoding module to said tone generator module; and a "sustain" switch, operatively connected to said sustaining processor module, adapted to enable the musician to suspend transmission of said "note off" event messages for as long said "sustain" switch remains in an "on" state;

whereby the musician, through sequentially interactive operation of said "accompaniment" and "sustain" switches in combination with each other and in strategic time relationship with notes of said lead voice performance, is enabled to enhance said self-accompaniment extemporaneously through such selective sustaining techniques;

and whereby, more particularly, the musician is enabled to set up a sustained accompaniment note group derived from selected notes of said lead voice performance, to hold said sustained group unchanging and independent of the playing of further lead voice notes, and to subsequently add more notes, as selected from said lead voice performance, to said sustained accompaniment note group.

5. The musical accompaniment control system as defined in claim 4 wherein said "accompaniment" switch and said "sustain" switch each comprise a low-profile footswitch of the momentary type which provides an "on" state while pressed downward and an "off" state while not pressed, said footswitches being disposed so as to facilitate operation by the musician from a standing position with one foot at each footswitch.

6. The musical accompaniment control system as defined in claim 4 further comprising, in combination therewith:

an echo module, interposed in a signal path of said accompaniment system, adapted to enable the musician to introduce and vary a recurring echo in notes of said accompaniment, said recurring echo being derived from corresponding notes of said lead voice; and an "echo" footswitch, operatively connected to said echo module, adapted to provide on/off control over said recurring echo, whereby the musician is enabled to operate said "echo" footswitch, in the manner of said "sustain" footswitch, in cooperation with said "accompaniment" footswitch, to utilize said recurring echo in the manner of said sustaining of notes of said accompaniment.

7. The musical accompaniment control system as defined in claim 6 wherein said echo module is further adapted to control and synchronize said recurring echo from a rhythmic pulse signal derived from a timing clock.

8. The musical accompaniment control system as defined in claim 6 wherein said echo is caused to repeat a designated finite number of times.

9. The musical accompaniment control system as defined in claim 6 wherein said echo is caused to repeat infinitely as long as said "echo" switch is held in an "on" state.

* * * * *